US006811591B2

(12) United States Patent
Hay et al.

(10) Patent No.: US 6,811,591 B2
(45) Date of Patent: Nov. 2, 2004

(54) AUTONOMOUS SYSTEM AND METHOD FOR EFFICIENTLY COLLECTING FUGITIVE AIRBORNE EMISSIONS FROM OPEN VESSELS

(75) Inventors: Kent James Hay, Mahomet, IL (US); Shaoying Qi, Urbana, IL (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 203 days.

(21) Appl. No.: 10/224,232

(22) Filed: Aug. 20, 2002

(65) Prior Publication Data

US 2002/0195334 A1 Dec. 26, 2002

Related U.S. Application Data

(63) Continuation-in-part of application No. 09/689,686, filed on Oct. 13, 2000, now abandoned.

(51) Int. Cl.[7] ..... B01D 19/00; B01D 47/00; C25D 21/11; C25D 17/00

(52) U.S. Cl. ..... 95/247; 95/266; 96/193; 96/194; 205/94; 204/277; 204/278

(58) Field of Search ..... 205/94, 755–757; 204/277–278; 96/193–194; 95/247, 266

(56) References Cited

U.S. PATENT DOCUMENTS

| | | | | | |
|---|---|---|---|---|---|
| 2,439,491 | A | * | 4/1948 | Schiffl | 204/277 |
| 4,113,586 | A | * | 9/1978 | Cook et al. | 205/574 |
| 5,139,636 | A | * | 8/1992 | Sawa et al. | 204/273 |
| 5,855,749 | A | * | 1/1999 | Kohut et al. | 204/270 |

* cited by examiner

*Primary Examiner*—Donald R. Valentine
(74) *Attorney, Agent, or Firm*—Earl H. Baugher, Jr

(57) ABSTRACT

An autonomous pushed liquid recirculation system (APLRS) is installed in a vessel, such as an electroplating tank. It situates around the interior perimeter and adjusts to changes in the level of liquid, maintaining the same location and orientation respective to the liquid's surface. It establishes a current near the surface that pushes liquid across the narrow horizontal dimension of the tank from a front wall to a rear wall. The current serves to push any bubbles resultant from operations within the tank to the rear wall. Over the rear wall is mounted an abbreviated exhaust hood covering only a short width of the surface of the tank along the rear wall. Because the exhaust system has to scavenge only a portion of the surface since all bubbles now burst along the rear wall, a much smaller air handling apparatus may be specified with an attendant savings in energy costs.

19 Claims, 9 Drawing Sheets

AUTONOMOUS SYSTEM AND METHOD FOR EFFICIENTLY COLLECTING FUGITIVE AIRBORNE EMISSIONS FROM OPEN VESSELS

RELATED INVENTIONS

This is a Continuation in Part of prior U.S. patent application Ser. No. 09/689,686, A Pushed Liquid Re-Circulation Method and System for an Electroplating Apparatus, by Hay et al., filed Oct. 13, 2000, since abandoned, and incorporated herein by reference.

STATEMENT OF GOVERNMENT INTEREST

Under paragraph 1(*a*) of Executive Order 10096, the conditions under which this invention was made entitle the Government of the United States, as represented by the Secretary of the Army, to an undivided interest therein on any patent granted thereon by the United States. This and related patents are available for licensing to qualified licensees. Please contact Bea Shahin at 217 373-7234 or Philip Stewart at 601 634-4113.

FIELD OF THE INVENTION

The field is fugitive emissions control. In particular, an autonomous system and method of its deployment is provided for minimizing fugitive airborne emissions of harmful products emitted by industrial operations, such as electroplating.

BACKGROUND

Some electroplating processes, such as those used to chrome plate metal, are highly inefficient. U.S. patents cover some of these processes. U.S. Pat. No. 2,862,863, Apparatus for Electrolytic Production of a Metal Product from Fused Salts, to Griffith, Dec. 2, 1958, details a method for producing a metal derived from an electrolyte such as halides of the target metals. U.S. Pat. No. 3,104,221, Self Circulation Solution Anode for Chromium Plating Vessels, to Hill, Sep. 17, 1963 provides a method for chrome plating the interior of an article that may have one end completely enclosed. U.S. Pat. No. 4,933,061, Electroplating Tank, to Kulkarni et al., Jun. 12, 1990 describes an electroplating tank with a sparger system in the bottom of the tank for directing solution upward and a cathode rack for holding items to be plated intermediate anode plates.

These plating systems create byproduct gases that rise as bubbles and burst, emitting a mist of chromic acid to the atmosphere. These emissions must be addressed to meet federal pollution standards since hexavalent chrome is a carcinogen.

In chrome plating solutions, these chromic acid-forming bubbles rise and disperse uniformly on the surface of the electroplating solution, away from the plating process. To treat the particulates thus generated requires a sufficient ventilation flow to insure they are forwarded to and captured by scrubbing filters. A typically required ventilation flow is 200–250 $ft^3$/min. of air per $ft^2$ of plating tank surface (cfm/sf). Conventional large ventilation systems remove the mist to an area of treatment removed from the plating tanks. These systems include large hoods, connecting ductwork, and at least one blower. The remote treatment technology may be a composite mesh pad unit or a packed bed scrubber. The large ventilation system incurs a large part of the energy costs to treat the mist as well as requiring initial capital for installation and consuming valuable space in a work area.

One somewhat unconventional treatment system is the Venturi/Vortex scrubber described in U.S. Pat. No. 5,149,411, Toxic Fumes Removal Apparatus for Plating Tank, to Castle, Sep. 22, 1992. This system, designed to replace larger more conventional systems, captures plating bubbles using a vortex drain operating by gravity. It was designed to separate the liquid and gas phases, re-circulate the liquid and treat the gas before exhausting the treated gas to the atmosphere. Although a patent was granted on this system and method, it had practical limitations that prevented it from being adopted commercially. Hay, K. J. et al., *Venturi/Vortex Scrubber Technology for Controlling/Recycling Chromium Electroplating Emissions*, ESTCP Demonstration Project Final Report, Technical Report 99/43, U.S. Army Construction Engineering Research Laboratory (CERL), March 1999.

U.S. Pat. No. 5,766,428, Chromium Plating Solution, Solution Waste from Chromium Plating and Closed Recycling System for Chromic Acid Cleaning Water in Chromium Plating, to Iida, Jun. 16, 1998 describes a large complex system for cleaning the mists emitted that uses a final treatment means preferably located underground.

U.S. Pat. No. 3,985,628, Pollution Control in Electroplating Systems, to Myers, Oct. 12, 1976, provides a bulky complex means to scrub the emitted mist using plating rinsing water, claiming a transfer of "chemical values" to the water and water to the air. The resultant chemically enriched water is returned to the plating solution while no auxiliary air is added other than that required to "sweep over" the plating baths.

Another concern with conventional electroplating tanks is their use of air circulation lines. Agitating (sparging) the plating solution with air bubbles near the plating activity ensures constant mixing of the solution thus yielding a uniform coating or plating. However, air bubbles thus generated increase surface emissions.

In view of the drawbacks associated with conventional plating systems, there is a need for a system and method that reduces costs associated with controlling fugitive emissions. A system and method of its use are provided for reducing the size of the costly, energy robbing ventilation system mandated to be installed over any open vessel emitting airborne hazards.

SUMMARY

To minimize the energy burden in treating fugitive emissions from open vessels that contain material that may volatilize and escape, an autonomous system, termed an autonomous pushed liquid recirculation system (APLRS), and method of its use are provided. The APLRS includes a fluid intake to a conduit connected to a pump, the intake positioned in the vessel along a portion of a wall of the vessel and a fluid exhaust from a conduit connected to an opposite side of the pump, the exhaust positioned in the vessel along a portion of a wall of the vessel approximately opposite the position of the intake. In a preferred embodiment, this configuration provides an equal path within the vessel from the pump to the intake and the pump to the exhaust. Because the APLRS depends on its location within the vessel in relation to fluid therein, it also incorporates a novel multi-part float that enables the APLRS to maintain an adequate geometry and position for fulfilling its function.

The dimensions of the vessel in which a preferred embodiment of the present invention may be employed include a tank having a length longer than its width, but also may include square, round, oval or polygonal shapes other than rectangular.

As compared to existing conventional fugitive emissions control systems and methods, an embodiment of the APLRS reduces ventilation requirements for electroplating tanks, thus reducing both capital equipment and operating (energy) costs.

The reduction in size and energy cost is effected through a reduction in the bubbles that arise to the surface of the vessel during industrial operations, such as electroplating. Fewer bubbles bursting on the surface reduce the amount of required forced ventilation.

A preferred embodiment of the APLRS meets the above goals by using jets of liquid to produce a uniform cross flow, i.e., a "push," near and across the surface of liquid in a vessel such as an electroplating tank. This pushes any bubbles arising to the surface of the vessel to one side of the vessel. These bubbles then cluster at a wall of the vessel due to not being able to resist the induced flow of the jets of liquid originating from an opposite wall.

This results in an effective reduction in the vessel's surface area since all of the bubbles are no longer dispersed over the entire surface but rather "pushed" to one side. In a preferred embodiment this side is a long side of the vessel because of the advantages of exploiting the physics of inducing the flow across the narrowest part of the vessel.

While controlling the location and area in which bubbles may burst, another advantage of the APLRS is the inducing of a natural recirculation of solution within the vessel. This leads to more efficient and uniform plating in those vessels employed in plating operations, for example. This may eliminate or reduce the need for a separate air sparger to achieve this function.

Further, in a preferred embodiment of the APLRS, the bubbles are "pushed" to a controlled collection point prior to becoming a fugitive emission, unlike existing emissions control systems that capture resultant mist in a "push-pull" air system only after a bubble has burst and become a fugitive emission anywhere on the surface of liquid in the vessel.

Thus, provided is an autonomous pushed liquid recirculation system for use with open systems containing hazardous materials that may be volatized. A preferred embodiment of the present invention will operate independently of the fluid level maintained in a vessel in which it is installed. This capability is enabled by a novel float system incorporated in the design of the APLRS.

DETAILED DESCRIPTION

A predecessor of the present invention was conceived to work with a system required to maintain a level of fluid in an open vessel to very close tolerances. This predecessor system is described fully in a related application, U.S. patent application Ser. No. 09/689,686, A Pushed Liquid Recirculation Method and System for an Electroplating Apparatus, to Hay et al., filed Oct. 13, 2000, and incorporated herein by reference. See also Hay (1999).

Figure 1:
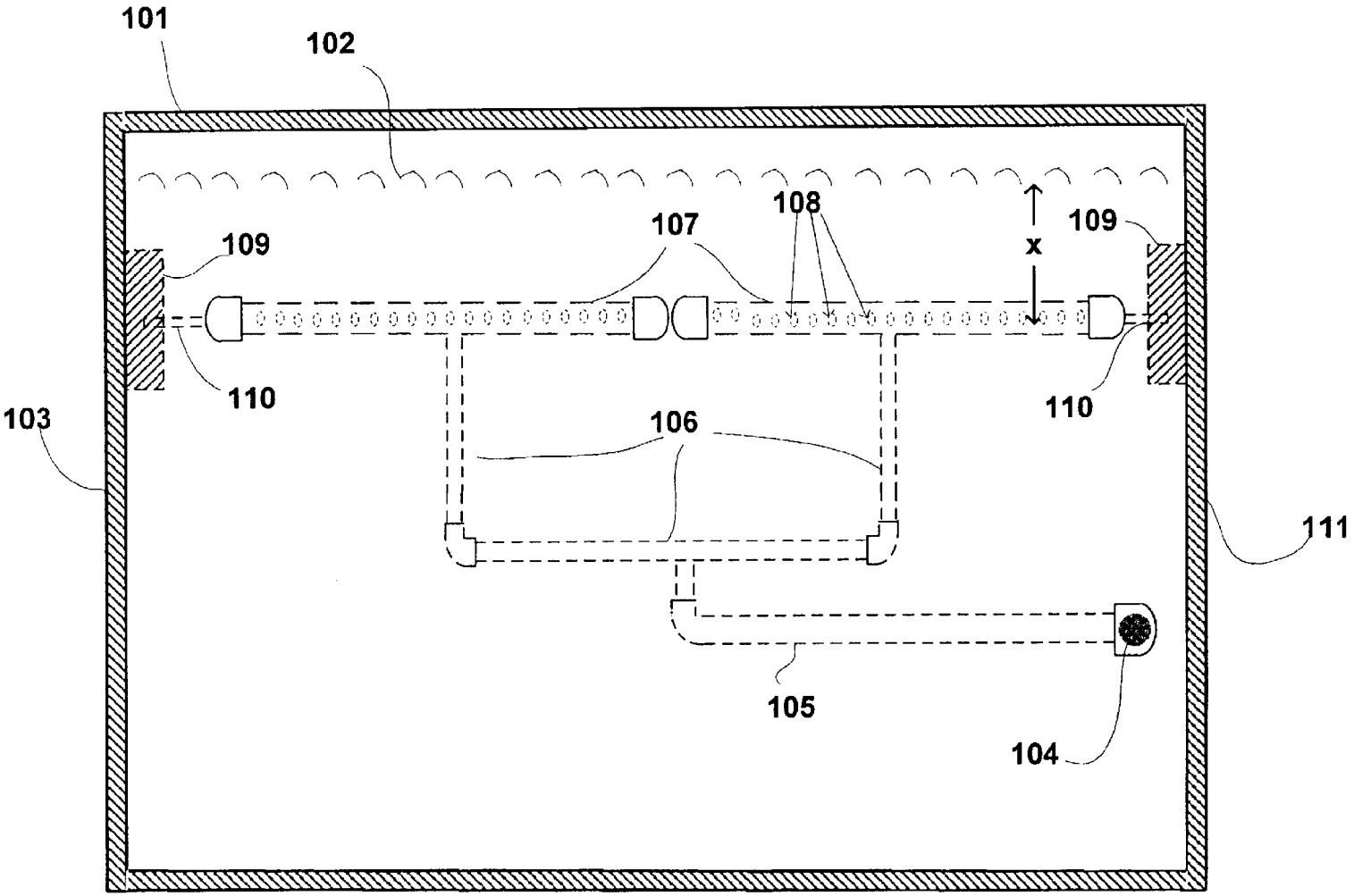
Fig. 1 Prior Art
FIG. 1 is a view of one side of a prior art system that uses some of the elements of a preferred embodiment of the present invention.

Refer to FIG. 1. First conceived by the inventors of the present invention as a non-autonomous pushed liquid recirculation system (PLRS), the piping and connections used to effect the flow of liquid to push bubbles 903 (not separately shown in FIG. 1 but shown in FIG. 9) to one side of a rectangular open tank 101 are shown in profile. This piping is connected to the exhaust side of a pump 301 (not separately shown in FIG. 1 but shown in FIG. 3) via a pipe 104 (shown in end view only in FIG. 1). These components are installed very close to a first long side 302 (labeled in FIG. 3), or front wall, of the tank 101 and just below the surface 102 of the liquid in the tank 101. At first 103 and second 111 ends of the tank 101 are fixed connection plates 109 to which connectors 110 from the distribution lines 107 are affixed. The piping itself may be comprised of a feed line 105 from an origination line 104 fed by the pump 301 to one or more feed arrangements 106 such as one or more Tees having multiple risers that provide an approximately equal flow of liquid to one or more distribution lines 107 incorporating holes 108 that are spaced and of a number and geometry to be in accordance with proper engineering design to effect a uniform current flow across the surface 102. These holes 108 are angled away from the first long side, or front wall 302, upward at an optimum angle, y, (not separately shown in FIG. 1 but shown in FIG. 9) and the distribution lines 107 are located at an optimum distance, x, just under the surface 102.

Figure 2:
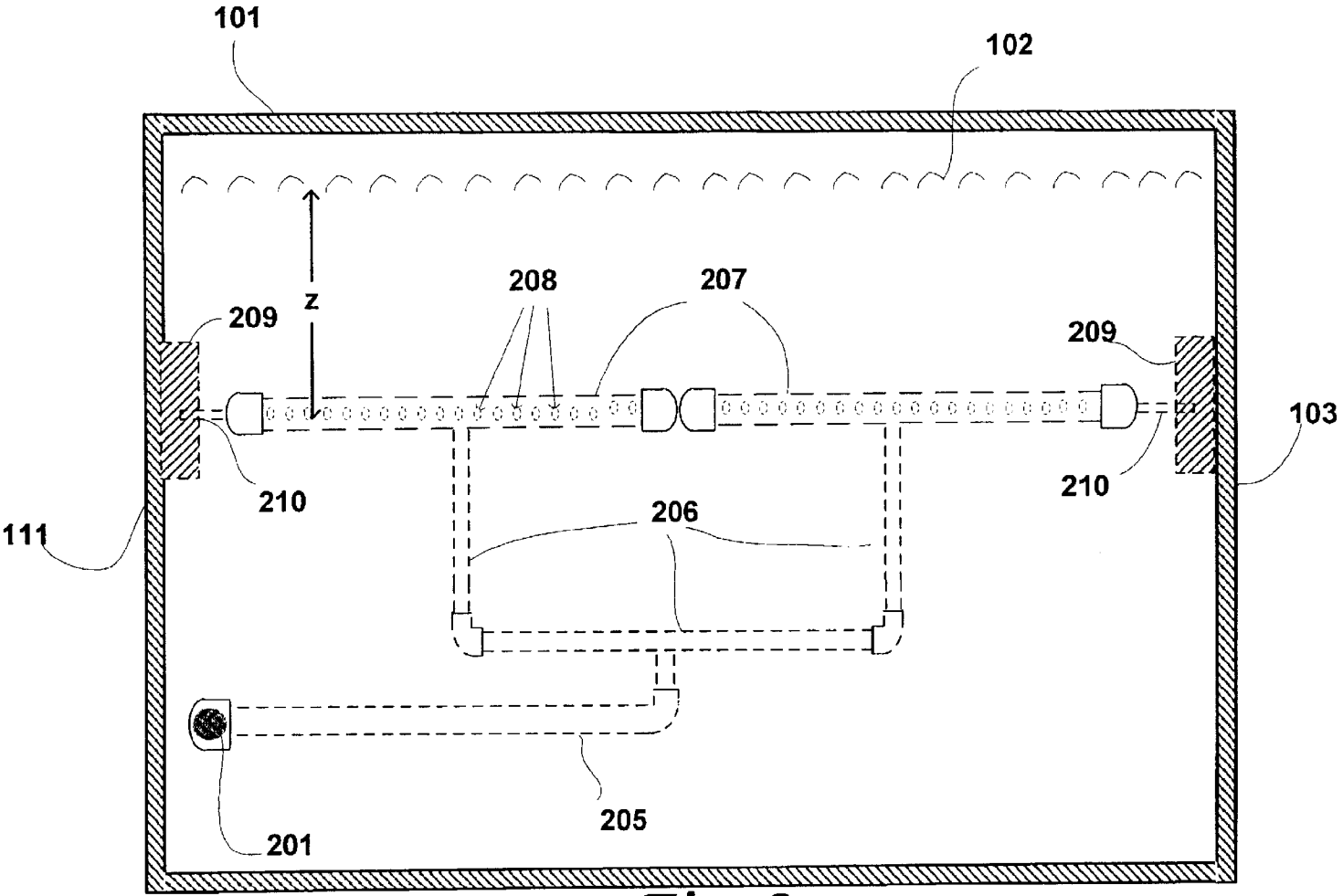
Fig. 2 Prior Art
FIG. 2 is a view of a prior art system, that of the side opposite that of FIG. 1.

Refer to FIG. 2. Shown is the profile view of the collection, or intake piping of the prior art PLRS, installed in like manner to the exhaust piping of FIG. 1, but on the opposite 303 long side (labeled in FIG. 3), or rear wall, of the tank 101. This piping is connected to the intake side of the pump 301 (not separately shown in FIG. 2 but shown in FIG. 3) via a pipe 201 (shown in end view only in FIG. 2). As with the exhaust/distribution components of FIG. 1, these components are installed very close to the rear wall 303 of the tank 101 and just below the surface 102 of the liquid in the tank 101. At first 103 and second 111 ends of the tank 101 are fixed connection plates 209 to which connectors 210 from the distribution lines 207 are affixed. The piping itself may be comprised of a collection arrangement 206 that may comprise multiple risers arranged in a Tee configuration similar to that shown in FIG. 1, a return line 205 connected to an intake line 201 to the pump 301. This "collection half" of the prior art PLRS collects an approximately equal flow of liquid from collection lines 207 incorporating appropriately sized and aligned holes 208. These holes 208, are oriented towards the back wall and preferably angled upward with respect to the horizontal at an angle of between 30° and 60° but most preferably at an angle of approximately 45°, collect fluid to be returned to the pump 301. The collection lines 207 are located at an optimum distance, z, under the surface 102, where z is greater in magnitude than x, i.e., the collection lines 207 are located deeper in the tank than the distribution lines 107. The depth, z, is chosen as close to the surface 102 as possible, generally less than about 250 mm (10 in.) and optimally about 150 mm (6 in.), so that it may effect an efficient return of fluid from the current generated from the distribution lines 107 while avoiding development of a vortex (not separately shown) that may entrain the bubbles 903 or air (not separately shown) from above the surface 102.

Figure 3:
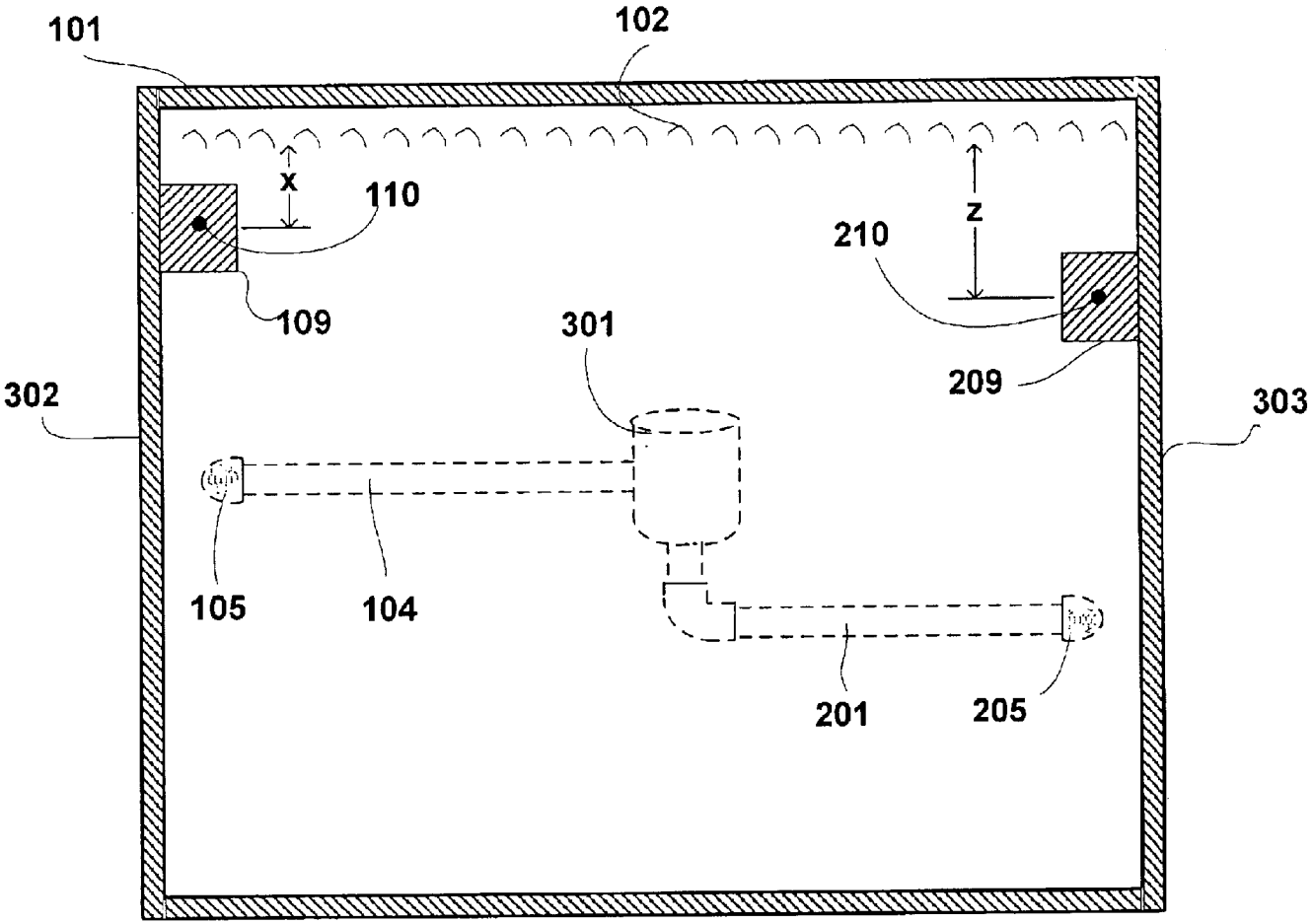
Fig. 3 Prior Art
FIG. 3 is an end view of the prior art system of FIGS. 1 and 2, the depicted end being the one closest to a submersible pump.

Refer to FIG. 3. A view of the prior art PLRS from the second end 111 of the rectangular tank 101 is shown. Here is it evident from the positions of the connectors 110, 210 that z>x. It is also evident that both z and x are fixed with respect to the tank 101. Note, to simplify FIG. 3, no power source is shown, nor means for transferring power, to the pump, although it is to be implied. As well, the pump may be connected to a throttle valve (not separately shown) and an inline flow meter (not separately shown) for purposes of controlling and monitoring flow. The operation of the pump may be controlled to operate only when operations are being conducted in the tank, such as electroplating. Further, the pump 301 may be one used with an existing system within a tank, such as a sparger (not separately shown).

Figure 4:
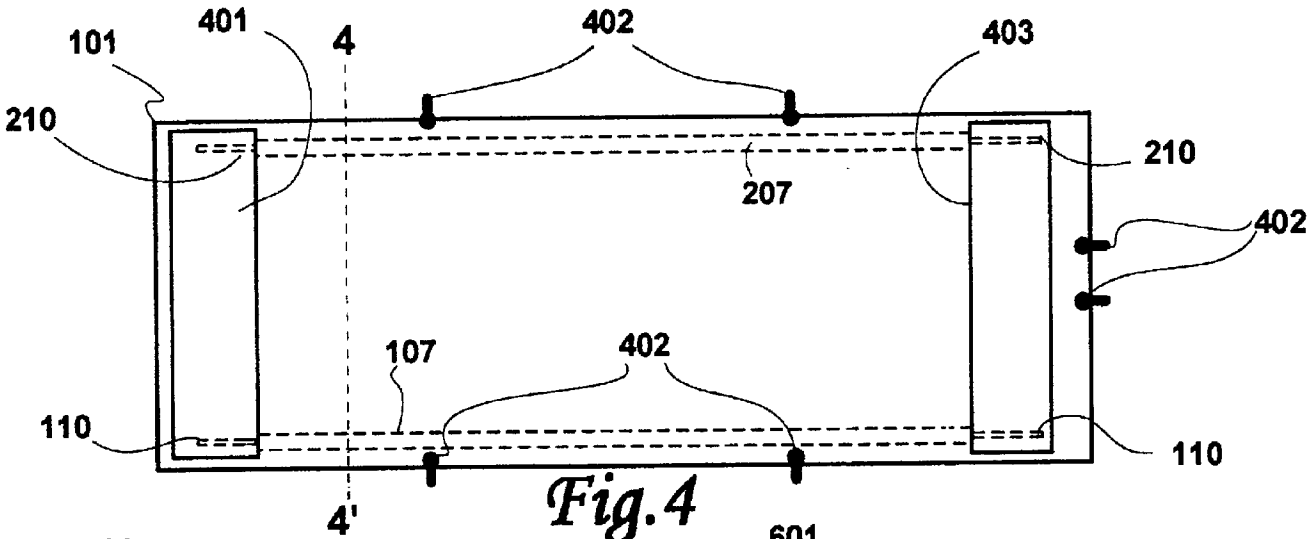
FIG. 4 is a top view of the topmost located components comprising a preferred embodiment of the present invention.

Refer to FIG. 4 showing a top view highlighting salient features of a preferred embodiment of the present invention, i.e., the APLRS, that may be viewed by looking directly down upon the top of the sides of a tank 101 and the surface 102 of liquid in the tank 101 in which a preferred embodiment of the APLRS is installed. At each of the narrow ends 103, 111 of the tank 101 are located "floats" 401, 403 to which the distribution 107 and collection 207 lines of the APLRS are connected via their respective connectors 110, 210. These floats 401, 403 are of a size, strength, and durability to support the APLRS in its expected installed environment and are designed according to accepted engineering practices. To support the distribution 107 and collection 207 lines piping along their long dimension, "supports" 402 are provided on the long sides 302, 303 of the tank 101. In one embodiment a submersible pump 301 is used and must be supported. To support the pump 301 and intake 201 and exhaust 104 lines, another set of identical supports 402 is shown overhanging the edge of the tank 101. These supports 402 are further described in the profile and side views of FIGS. 5 and 6, respectively.

Figure 6:
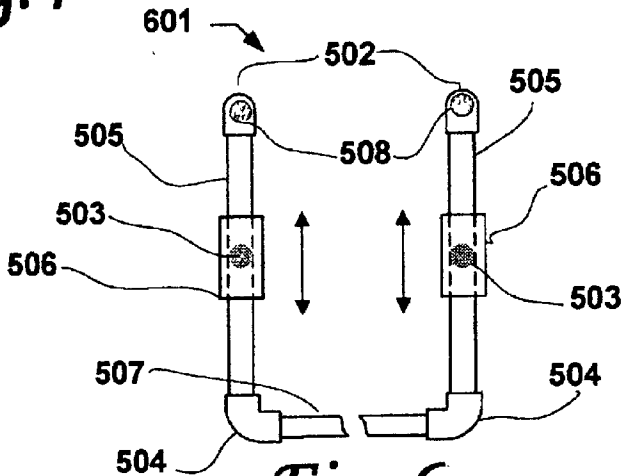
FIG. 6 is a detail of components of the float support assembly of FIG. 5 as shown in a profile view.
Figure 5:
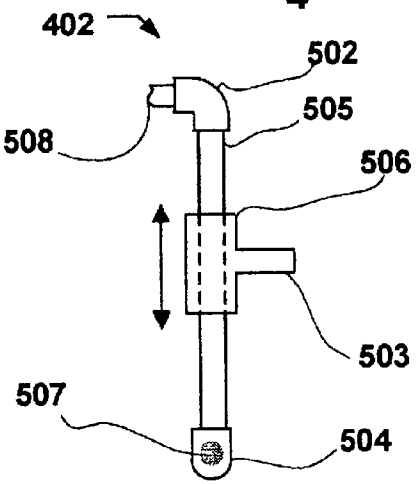
FIG. 5 details an end view of the vertical part of one of multiple float support assemblies used with a preferred embodiment of the present invention.

FIG. 5 depicts one of the supports 402 of FIG. 4 as shown looking down one of the sides 111, 302, 303 of the tank 101 on which it is mounted. In its humblest form, it comprises a configuration of CPVC pipe components, e.g., CPVC of 3.8 cm (1½ in.) inside diameter. At the top is a straight horizontal piece 508 that provides some overhang of the side 111, 302, 311 of the tank 101 to insure the support 402 does not fall into the tank 101. To effect a right angle an elbow 502 is attached to the straight piece 508. A vertical piece 505 is attached to the elbow 502 to effect a length necessary to accommodate expected fluctuation of the level of the surface 102 of the liquid in the tank 101 with some safety measure thrown in. Encircling this vertical piece 505 is a T-collar 506, e.g., CPVC reducing Tee connector of inside diameter of 5.0 cm (2 in.) with a reducing connection on the leg of the Tee to 3.8 cm (1½ in.) CPVC. This T-collar 506 acts to slide up and down the vertical piece 505 as the surface 102 of the liquid changes. To the reducing connection is affixed a "tab" 503, e.g., a short section of CPVC of inside diameter 3.8 cm (1½ in.). In the shown embodiment for each of the vertical supports 402, this tab 503 will support the applicable distribution 107 or return 207 lines along the long sides 302, 303 of the tank 101 and the intake 201 and exhaust 104 lines along the pump end 111 of the tank 101. At the base of the vertical piece 505 is an elbow 504 that provides a change in direction perpendicular to both the tab 503 and the top horizontal straight piece 508. This elbow 504 allows two vertical supports 402 to be connected via a straight horizontal pipe 507 as shown in FIG. 6. The configuration 601 is used with the floats 401, 403 and connectors 110, 210 thereto to provide an autonomous PLRS, i.e., an APLRS, an efficient emissions control system that is independent of the system for which it is controlling fugitive emissions.

Figure 7:
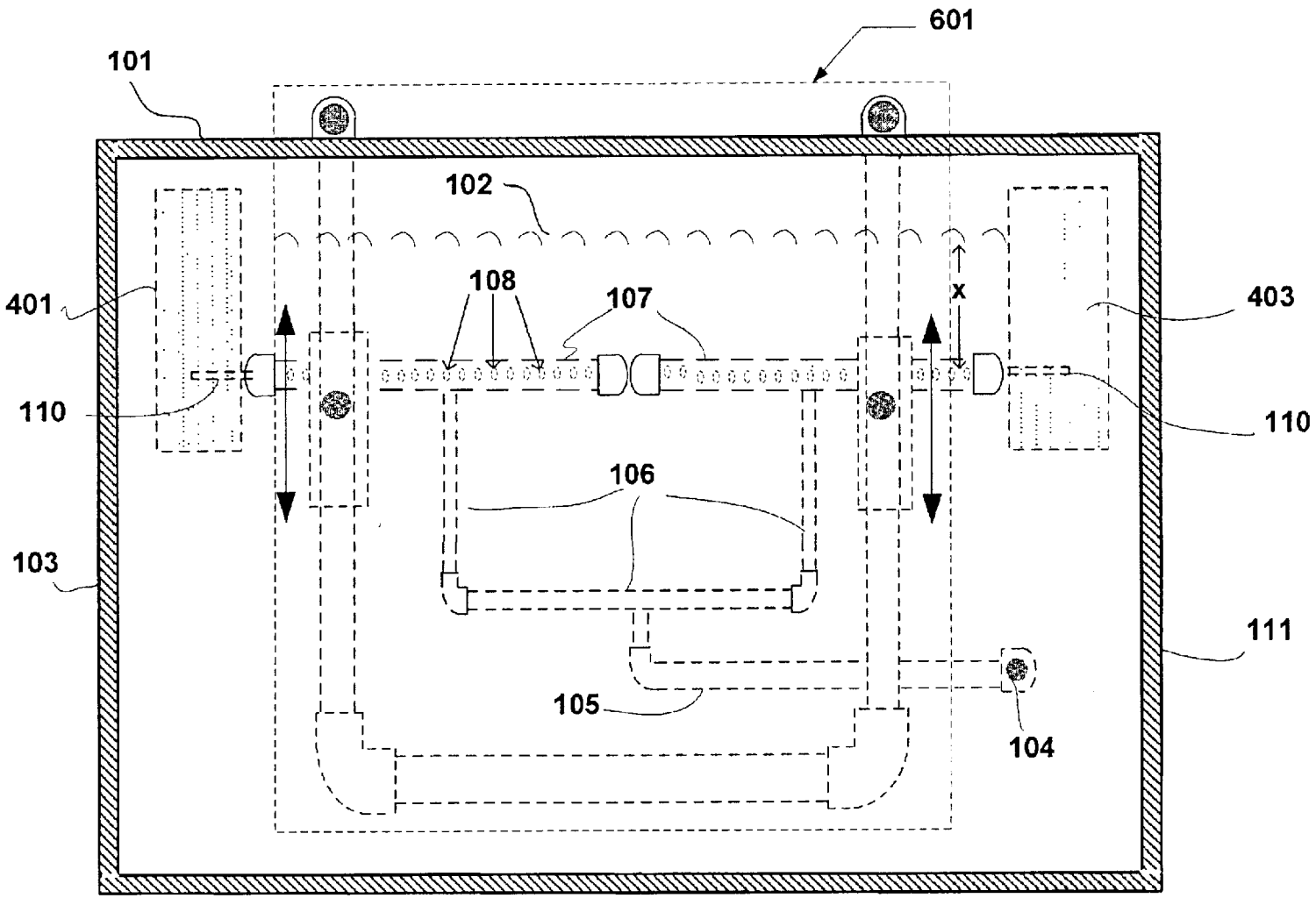
FIG. 7 depicts a front side view of a preferred embodiment of the present invention emplaced within a rectangular vessel.

Refer to FIG. 7. Shown is a view of a front wall 302 of a rectangular tank 101 in which an embodiment of the APLRS has been installed. Note that the vertical piece 505 (not labeled in FIG. 7) is quite long so that, as depicted, the level of fluid in the tank 101 may be varied substantially. Although this is not a preferred embodiment if installed in a conventional electroplating tank, it may be useful in other applications in which deep tanks may be used with minimal loading for other than their main purpose: Thus, this may be useful when a small batch or smaller pieces are being processed and it is not necessary to use the whole depth of the tank 101. This gives the operator increased flexibility, especially if the hood 901 (not separately shown in FIG. 7 but shown in FIG. 9) is able to be run down the inside of the tank 101 to accommodate fluid level changes.

Figure 8:
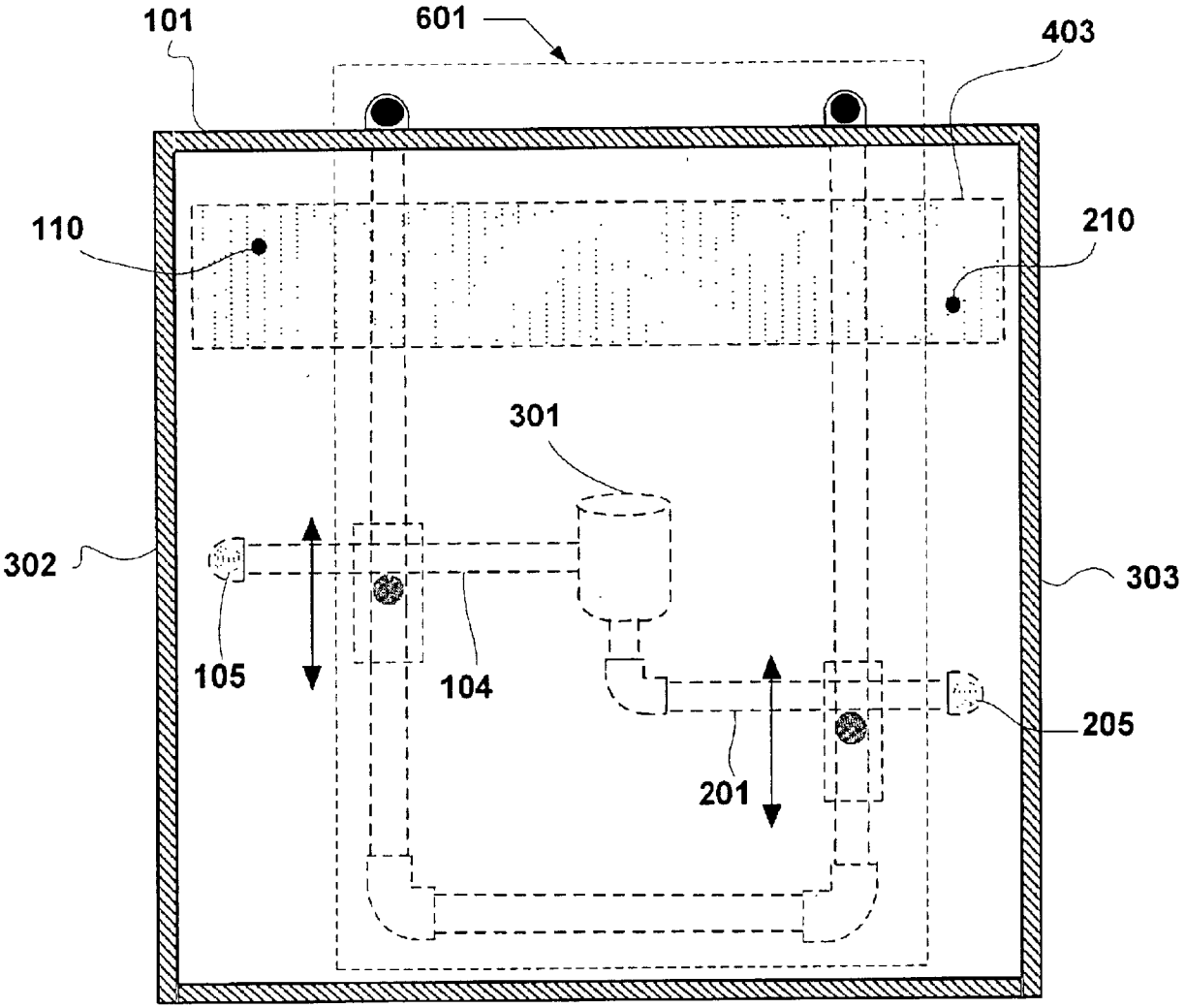
FIG. 8 shows an end view of the system as emplaced in FIG. 7, the end containing a submersible pump.

Refer to FIG. 8 depicting a view of the support 601 installed at the pump end 111 of the tank. Note the different relative positions of the connectors 110, 210 shown in end view. The collection lines 207 (as shown in FIG. 2) must always be below that of the distribution lines 107 (as shown in FIG. 1) and the depth, x, of the distribution lines 107 below the surface 102 should be optimized to effect a uniform strong current across the surface for pushing the bubbles 903 (as shown in FIG. 9).

Figure 9:
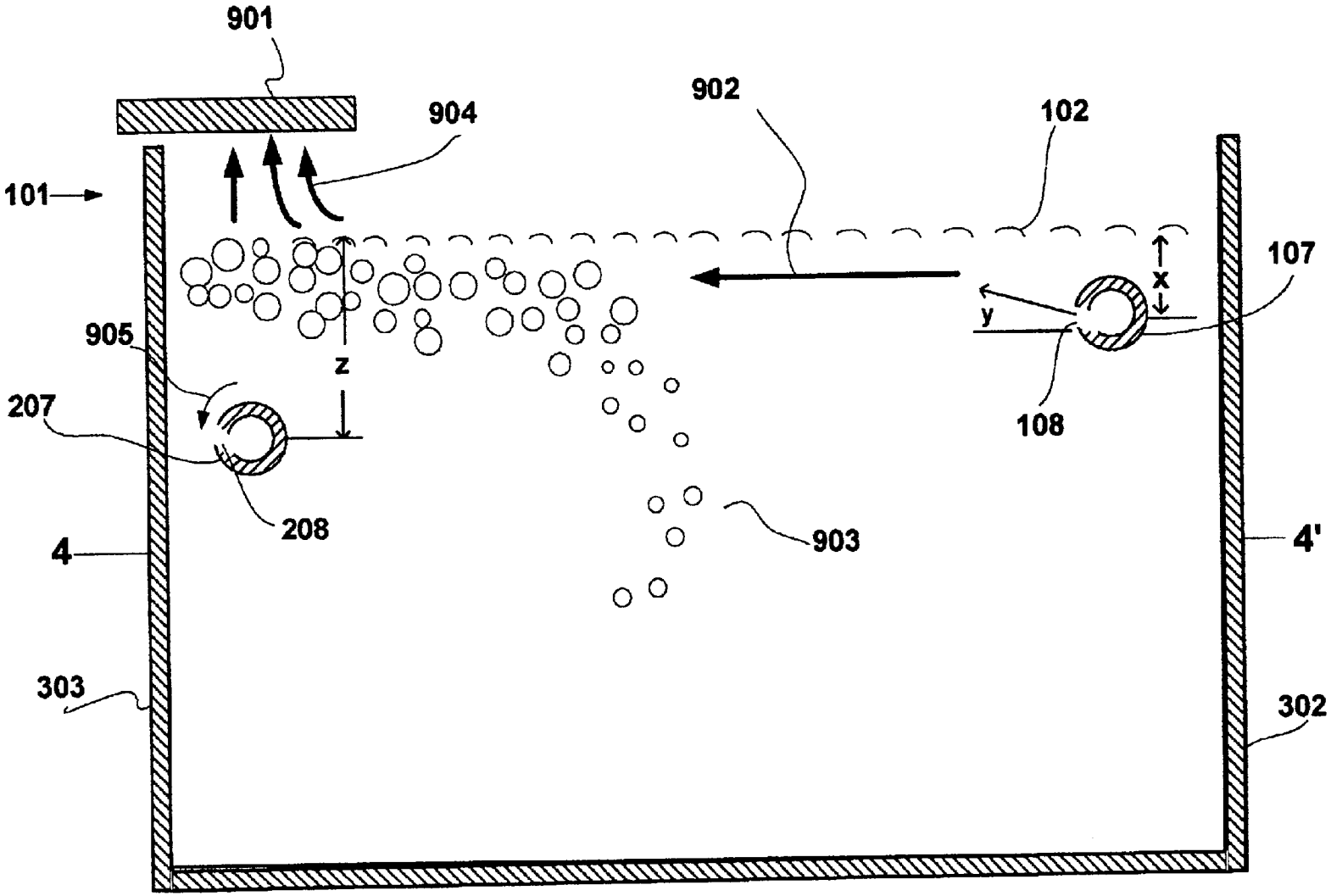
FIG. 9 is a cross section through 4–4' of FIG. 4 showing the activity of a preferred embodiment of the present invention in operation.

Refer to FIG. 9, a vertical cross section through the tank 101 of FIG. 4 at 4–4' such that one is viewing the tank 101 from the end 103 with the front side 302 to the viewer's right. With respect to the distribution and collection of liquid, the APLRS operates in the same manner as the PLRS described in U.S. patent application Ser. No. 09/689,686, but will be reiterated here for convenience. Fluid is pumped from the pump 301 up to a distribution lines 107 where it exits through holes 108 oriented toward the back wall 303 at a pre-specified angle, y. This establishes a "current" in the direction of the single large arrow 902. A nominal time of passage for liquid in this current to flow from a front wall 302 to a rear wall 303 of an average electroplating tank 101 is two seconds. Preferably, this may be accomplished with a flow rate of from 40–200 liters/min./$m^2$ (1.0–5.0 gallons/min./$ft^2$) of liquid surface 102 area and most preferably with a flow rate of about 120 lpm/$m^2$ (three gpm/$ft^2$) of liquid surface 102 area. As bubbles 903 are initiated by some operational action within the tank 101, e.g., electroplating, they rise to the surface 102 and meet this current and are deflected to the rear wall 303 of the tank 101. The rear wall 303 has an exhaust hood 901 placed over it for collecting any emissions occurring as a result of these bubbles 903 bursting as indicated by the arrows 904. Note that the exhaust hood 901 extends only a portion of the way over the tank 101, requiring a fraction of the surface 102 area of the tank to be exhausted, thus reducing the size of the equipment as well as the amount of energy needed to operate it. Further, since the exhaust hood 901 need not cover the entire surface 102, it may be located closer to the portion of the surface 102 that it does cover, thus requiring less energy to "pull" any fugitive emissions from the bursting bubbles 903 along the rear wall 303. Further, access above the tank 101 is facilitated since no large ventilation hood covers most of the surface 102, thus enabling use of devices such as overhead cranes (not separately shown) to move items for treatment in the tank 101. Near the rear wall 303 are the collection lines 207 that return fluid to the pump 301 through holes 208 in the collection lines 207. The collection lines 207 and holes 208 therein are arranged near the rear wall 303 to take advantage of the rebound effect (as indicated by the arrow 905) induced by the current terminating at the rear wall 303. In an optimum configuration to minimize adverse components of rebound from the rear wall 303 due to cross flow at the surface 102, these holes 208 are oriented toward the rear wall 303 at approximately 45° from the horizontal, although they may be oriented from 30° to 60° upward from the horizontal in other embodiments. Note that if this rebound effect is not present, bubbles 903 will drift from the location of the back wall 303 and perhaps burst in a location not under the exhaust hood 901.

Figure 10:
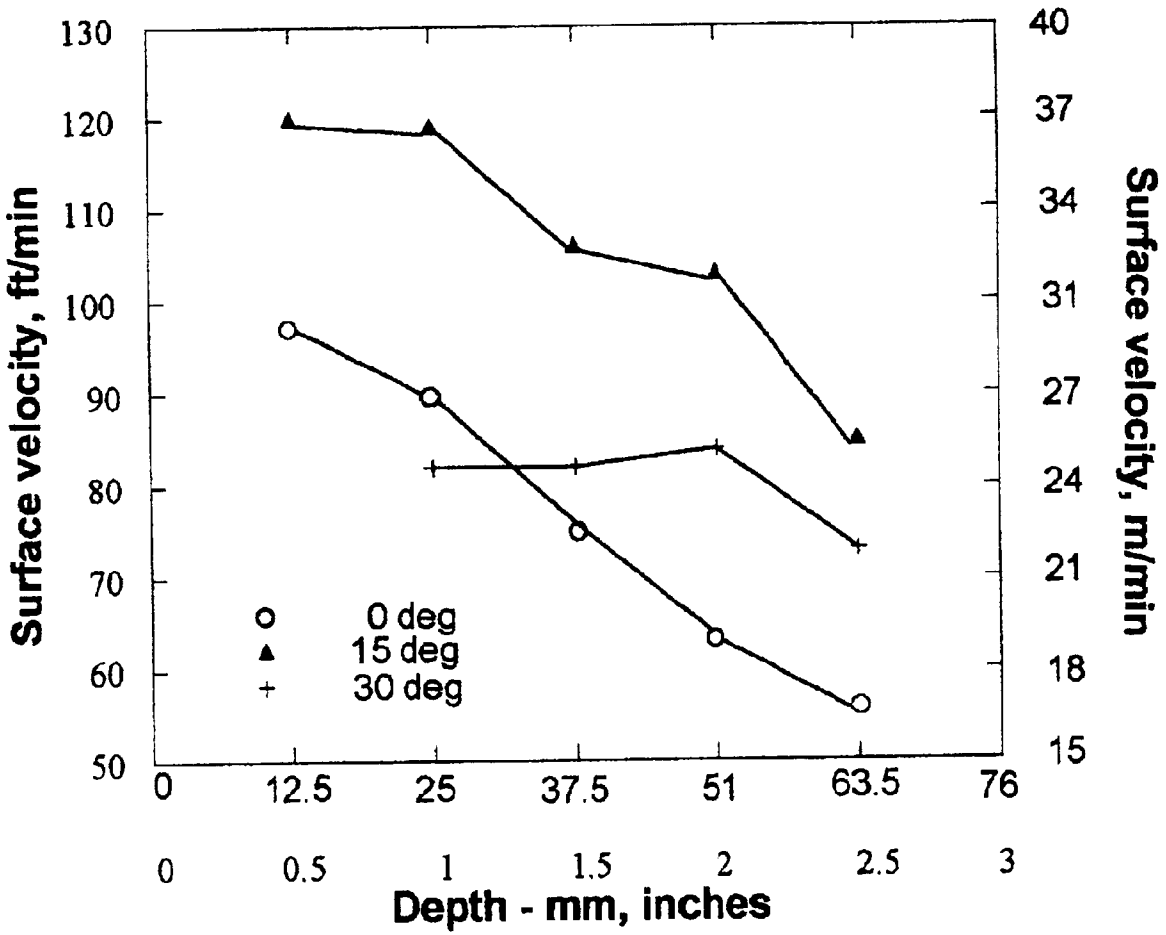
FIG. 10 is a graph showing surface velocity versus depth of the exhaust ports in piping used with a preferred embodiment of the present invention.

Refer to FIG. 10. Shown are test results taken from a tank 101 in which the angle, y, of the holes 108 in the distribution lines 107 were varied with respect to the horizontal and with the depth, x. An optimum value of z had been determined previously. The angle, y, was investigated at three values: 0°, 15°, and 30° for depths, x, varied in half-inch increments from 0.5 in (12.5 mm) to 2.5 in. (63.5 mm). Results show the maximum flow is available in a very narrow depth range of 12.5–25 mm (0.5–1.0 in.) at an angle, y, of 15°. However, for values of x less than 1.0 in., splashing occurs, exacerbating the emissions problem. This demonstrates the critical need for maintaining the value of x within a preferable narrow range of 1.0–2.0 in., and more preferably between about 1.0–1.5 in., to not only optimize flow but also minimize unintended emissions. This is accomplished via the unique capability provided by the APLRS to adjust depth with change in the level of the liquid surface 102 instantaneously and simply, with no need for active control devices. This capability also facilitates installing the APLRS in any existing system without in-tank retrofit of controls. It also permits a significant reduction in the size of the emissions control system required. The burden imposed is a small increase in energy to run the pump 301 and a reduction in available tank capacity due to installation of the lines 104–107, 201, 205–207 and pump 301 along three edges 111, 302, 303 and floats 401, 403 along the ends 103, 111. For new designs, this could be accommodated by a slight increase in the dimensions of a tank 101, for example. However, existing tank designs equipped with in-tank spargers may no longer need them upon installing an APLRS, thus recouping some lost energy and volume in this manner.

Figure 11:
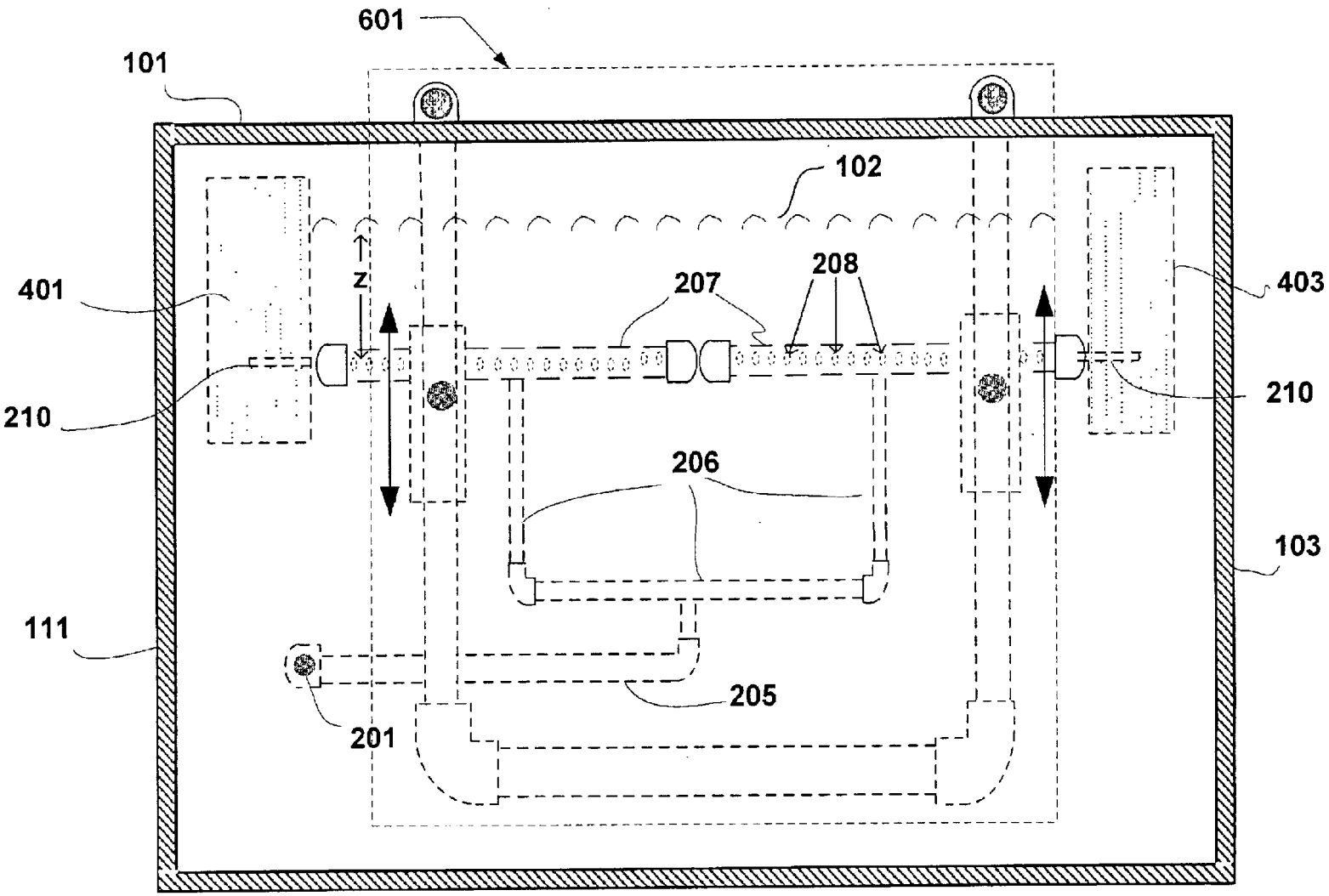
FIG. 11 depicts a view taken from the side opposite the view of FIG. 7.

Refer to FIG. 11. Shown is a view of an APLRS installation that is the mirror image of FIG. 7 as installed on the rear wall 303 of the tank 101. Note that the collection lines 207 are installed deeper, i.e., z>x, along the back wall 303.

Although specific types, geometry and orientations of piping, floats, and pumps are discussed, other similar types, geometry and orientations of piping, floats, and pumps, including those that may have only some of the constituents used in the above described examples, may be suitable for reducing fugitive emissions using a structure or method that falls within the ambit of a preferred embodiment of the present invention as provided in the claims herein. For example, the vertical risers of the support configuration 601 may comprise flexible hose and the pump 301 may be affixed near the bottom of the tank 101 so that a support configuration 601 is not required on an end 111 of the tank 101.

We claim:

1. An autonomous system for collecting fugitive emissions resulting from bubbles bursting on the top surface of a liquid contained in a vessel open to the atmosphere, the perimeter of said vessel consisting of at least a front and a back portion, comprising:

a liquid distribution apparatus suspended in said liquid at a pre-specified depth and located adjacent at least part of the inside perimeter of said vessel, said apparatus comprising at least one pipe and pipe connections assembled to permit a distribution of at least a portion of said liquid near said surface, said distribution initiated along said front portion and oriented toward said back portion, said apparatus further assembled to collect at least a portion of said liquid along said back portion, wherein said pipe and pipe connections are connected to at least one pump in such a manner as to effect a system for circulating said liquid in said vessel, and wherein said apparatus establishes a flow along said top surface from said front portion to said back portion such that said bubbles are pushed to an area near said back portion; and flotation support for said liquid distribution apparatus, wherein said support enables said apparatus to maintain a constant orientation with respect to said top surface.

2. The autonomous system of claim 1 further comprising at least one pump.

3. The autonomous system of claim 1 in which said flotation support is provided along said front portion and said back portion in like manner.

4. The autonomous system of claim 1 in which said vessel is rectangular, said front and back portions consisting of front and back walls respectively, said front and back walls extending the longest dimension of said vessel in a horizontal plane, and having end walls, each with a narrowest dimension of said vessel in a horizontal plane.

5. The autonomous system of claim 4 in which said apparatus is installed adjacent said front and back walls and one said end wall.

6. The autonomous system of claim 1 further comprising an abbreviated exhaust hood.

7. The autonomous system of claim 1 in which said apparatus accomplishes said flow via provision of first and second sets of holes in a topmost portion of said apparatus, at least one portion of said topmost portion of said apparatus established at a pre-specified distance from said top surface, said holes pre-specified as to number, location, arrangement and orientation with respect to said vessel, wherein movement of said liquid through said first set of said holes establishes said flow, and wherein return of said liquid to be re-circulated is accomplished via said second set of holes.

8. The autonomous system of claim 7 in which said first set of holes is oriented away from said front portion and aligned at a pre-specified upward angle with the horizontal, the center of said holes in said first set located at a depth below said surface between about 12.5 mm (0.5 in.) and 63.5 mm (2.5 in.).

9. The autonomous system of claim 8 in which said pre-specified upward angle is between about 0° and 30°.

10. The autonomous system of claim 8 in which said pre-specified upward angle is about 15° and said centers of said holes in said first set are located at a depth below said surface between about 25.4 mm (1.0 in.) and 63.5 mm (2.5 in.).

11. The autonomous system of claim 8 in which said pre-specified upward angle is about 15° and said centers of said holes in said first set are located at a depth below said surface between about 25.4 mm (1.0 in.) and 37.5 mm (1.5 in.).

12. The autonomous system of claim 7 in which said second set of holes is oriented away from said rear portion and aligned at a pre-specified upward angle with the horizontal, the center of said holes in said second set located at a depth below said surface between about 152 mm (6.0 in.) and 254 mm (10.0 in).

13. The autonomous system of claim 12 in which said pre-specified angle is between about 30° and 60°.

14. The autonomous system of claim 13 in which said pre-specified angle is about 45° and said center of said holes in said first set are located at a depth below said surface of about 152 mm (6.0 in.).

15. The autonomous system of claim 1 in which said flow is established at a rate between about 40–200 lpm/$m^2$ (1.0–5.0 gpm/$ft^2$) of area of said surface.

16. The autonomous system of claim 1 in which said flow is established at a rate of about 120 lpm/$m^2$ (3.0 gpm/$ft^2$) of area of said surface.

17. A method for efficiently controlling fugitive emissions from bubbles appearing on the surface of a liquid within a vessel having at least a front and a back wall opposite said front wall, said vessel open to the atmosphere, comprising:

establishing a cross flow of said liquid near said surface and across a narrowest horizontal dimension of said surface, said cross flow to initiate adjacent to said front walls, said front wall defined as that said wall at which said cross flow is established;

collecting at least a portion of liquid resultant from said cross flow rebounding from said back wall;

recirculating said collected liquid to maintain said cross flow; and collecting any fugitive emissions resultant from any said bubbles that burst via an exhaust hood adjacent to and above said back wall, wherein, as said bubbles reach said surface, said cross flow pushes said bubbles in said liquid across said surface from said front wall towards said back wall.

18. A device at least partially open to the atmosphere and incorporating an autonomous system for collecting fugitive emissions resulting from bubbles bursting on the top surface of a liquid contained in said device, a perimeter of said device consisting of at least a front and a back portion, comprising:

a container for holding said liquid;

a liquid distribution apparatus suspended in said liquid within said container at a pre-specified depth and located adjacent at least part of the inside perimeter of said device, said apparatus comprising at least one pipe and pipe connections assembled to permit a distribution of at least a portion of said liquid near said surface, said distribution initiated along said front portion and oriented toward said back portion, said apparatus further assembled to collect at least a portion of said liquid along said back portion, wherein said pipe and pipe connections are connected to at least one pump in such a manner as to effect a system for circulating said liquid in said vessel, and wherein said apparatus establishes an approximately horizontal flow along said top surface from said front portion to said back portion such that said bubbles are pushed to an area near said back portion; and flotation support for said liquid distribution apparatus, wherein said support enables said apparatus to maintain a constant orientation with respect to said top surface.

19. The device of claim 18 in which said device is an electroplating tank.

* * * * *